US005924555A

United States Patent [19]

Sadamori et al.

[11] Patent Number: 5,924,555

[45] **Date of Patent: *Jul. 20, 1999**

[54] PANEL SWITCH MOVABLE CONTACT BODY AND PANEL SWITCH USING THE MOVABLE CONTACT BODY

[75] Inventors: Akira Sadamori; Koji Sako; Yuji Okamoto, all of Okayama, Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/951,810

[22] Filed: Oct. 16, 1997

[30] Foreign Application Priority Data

Oct. 22, 1996 [JP] Japan ..... 8-279158
May 8, 1997 [JP] Japan ..... 9-117822

[51] Int. Cl.[6] ..... H01H 13/70; H01H 1/06; H01H 9/02

[52] U.S. Cl. ..... 200/512; 200/238; 200/513; 200/516; 200/305

[58] Field of Search ..... 200/1 B, 5 R, 200/5 A, 512–517, 304, 305, 313, 314; 29/412

[56] References Cited

U.S. PATENT DOCUMENTS 3,538,389 11/1970 Levesque ..... 361/777
3,967,084 6/1976 Pounds ..... 200/275
4,005,293 1/1977 Boulanger ..... 200/5 A
4,018,999 4/1977 Robinson et al. ..... 200/5 A
4,035,593 7/1977 Riniker ..... 200/5 A
4,046,981 9/1977 Johnson et al. ..... 200/5 A
4,254,309 3/1981 Johnson ..... 200/5 A
4,365,120 12/1982 Pounds ..... 200/5 A
4,365,408 12/1982 Ditzig ..... 200/292 X
4,412,113 10/1983 Mitsugi et al. ..... 200/406
4,916,275 4/1990 Almond ..... 200/516
5,001,308 3/1991 Mori ..... 200/5 A
5,136,131 8/1992 Komaki ..... 200/516
5,225,818 7/1993 Lee et al. ..... 200/314
5,228,562 7/1993 Burk ..... 200/512
5,403,980 4/1995 Eckrich ..... 200/52 R
5,557,079 9/1996 Jackson et al. ..... 200/5 A
5,661,279 8/1997 Kenmochi ..... 200/305 X
5,778,507 7/1998 Grannan et al. ..... 29/412

*Primary Examiner*—J. R. Scott
*Attorney, Agent, or Firm*—Pearne, Gordon, McCoy & Granger LLP

[57] ABSTRACT

In a panel switch movable contact body, and a panel switch using the movable contact body, the upwardly curved upper surface of a dome-shape movable contact 1 made of a thin elastic metal plate is bonded to a sheet 12 of insulating film whose lower surface is coated with an adhesive agent 12A, and the opening of the dome-shaped movable contact 1 is closed with a separator 13 which is bonded to the adhesive surface of the sheet 12. Hence, the panel switch movable contact body, and the panel using the latter is small in the number of components, and low in manufacturing cost, and can be assembled with high efficiency.

10 Claims, 9 Drawing Sheets

PANEL SWITCH MOVABLE CONTACT BODY AND PANEL SWITCH USING THE MOVABLE CONTACT BODY

BACKGROUND OF THE INVENTION

1. Field of the Invention

This invention relates to a movable contact body employed for an operating panel of various electronic equipment (hereinafter referred to as "a panel switch movable contact body"), and to a panel switch using the movable contact body.

2. Description of the Related Art

A conventional panel switch movable contact body, and a panel switch using the movable contact body, will be described with reference to FIGS. 8A, 8B and 9A, 9B.

FIGS. 8A and 8B are an exploded perspective view, and a sectional view, respectively, showing a conventional panel switch movable contact body. In those figures, reference numeral 1 designates a dome-shaped movable contact made of a thin, elastic, metal plate; and 2, a spacer of insulating film. An adhesive agent 2A is applied to the lower surface of the spacer 2, so that a separator 3 is bonded to the lower surface of the spacer 2. The spacer has a plurality of holes 2B, in which the movable contacts 1 are inserted. Each of the movable contacts 1 is upwardly curved (dome-shaped), and secured to the upper surface of the spacer 2 with its upper surface covered with an insulating film sheet 4 whose lower surface is applied with an adhesive agent 4A.

Reference numeral 5 denotes a protective sheet of insulating film adapted to protect the movable contacts 1 and prevent the corrosion of the latter 1 by the gases in air or the sticking of foreign matters thereto. An adhesive agent 5A is applied to the upper surface of the protective sheet 5, so that the latter 5 is bonded to the lower surface of the spacer 2 through a separator 3. That is the protective sheet 5 covers the lower surfaces of the movable contacts 1, thus completing a panel switch movable contact body 10.

FIGS. 9A and 9B are an exploded perspective view and a sectional view, respectively, showing a panel switch employing the conventional panel switch movable contact body. In those figures, reference numeral 6 designates a wiring board (or printing circuit board) having central stationary contacts 6A and outside stationary contracts 6B on the upper surface. The protective sheet 5 and the separator are removed from the panel switch movable contact body 10A. That is, the resultant movable contact body 10A is bonded to the wiring board 6 through the adhesive agent 2A in such a manner that the outer periphery of each of the movable contacts is on the respective outer stationary contact 6B, and the central top thereof is confronted with the respective central stationary contact. Thus, the panel switches 11 have been manufactured.

A push button 7 of flexible rubber or resin is set above each of the panel switch thus manufactured. When the operating section 7A of the push button 7 is depressed, a depressing portion 7B formed on the lower surface of the operating section 7A is caused to depress the movable contact 1 through the sheet 4. As a result, the movable contact 1 performs reverse motion, so that the central part thereof is brought into contact with the central stationary contact 6A; that is, the central stationary contact 6A of the wiring board 6 is electrically connected to the outside stationary contact 6B. Upon release of the push button 7, the elastic restoring force of the movable contact 1 acts to disconnect the central part of the movable contact 1 from the central stationary contact 6A; that is, the panel switch is turned off as shown in FIG. 9B.

However, the above-described conventional panel switch movable contact body, and panel switch using the movable contact body suffer from the following difficulties: It employs the movable contacts 1, sheets 4, spacer 2, protective sheet 5, and so forth. That is, the number of components is relatively large, and the number of steps of bonding those components is also large. Hence, the switch assembling work is rather troublesome. As a result, the resultant panel switch is high in manufacturing cost. Furthermore, static electricity is liable to sneak in various electronic equipment through the panel switches. Hence, on the side of the electronic equipment, it is necessary to devise a countermeasure against it.

SUMMARY OF THE INVENTION

In view of the foregoing, an object of the invention is to provide a panel switch movable contact body which is small in the number of components, simple in assembling work, and low in manufacturing cost and in which a countermeasure is devised against static electricity which may sneak in the concerning electronic equipment, and to provide a panel switch using the movable contact body.

The foregoing object of the invention has been achieved by the provision of a panel switch movable contact body, and a panel switch using the movable contact body in which the upwardly curved upper surface of a dome-shape movable contact made of a thin elastic metal plate is bonded to a sheet of insulating film whose lower surface is coated with an adhesive agent, and the opening of the dome-shaped movable contact is closed with a separator which is bonded to the adhesive surface of the sheet.

Hence, the panel switch movable contact body, and the panel using the latter is small in the number of components, and low in manufacturing cost, and can be assembled with high efficiency.

The panel switch movable contact body according to a first aspect of the invention comprises: a sheet made of an insulating film whose lower surface is coated with an adhesive agent; a dome-shaped movable contact which is made of a thin elastic metal plate in such a manner that the movable contact is bonded to the adhesive surface of the sheet, and the upper surface thereof which is upwardly curved is covered with the sheet; and a separator bonded to the adhesive surface of the sheet in such a manner as to cover the lower opening of the dome-shaped movable contact. Hence, the movable contact body is small in the number of components, and can be assembled with high efficiency.

According to a second aspect of the invention, in the panel switch movable contact body of the first aspect of the invention, a conductive film is formed on the upper surface of the sheet made of an insulating film. Hence, in the movable contact body, static electricity which tends to go in the electronic equipment through the panel switch is grounded through the conductive film. Therefore, it is unnecessary to devise a counter measure against static electricity on the side of the electronic equipment.

According to a third aspect of the invention, in the panel switch movable contact body according to the first aspect, the movable contact is bonded to the sheet in such a manner the lower peripheral edge of the movable contact is spaced from the adhesive surface of the sheet. This feature prevents the entrance of the adhesive agent of the sheet into the movable contact. In the switch movable contact body, the movable contact is more smoothly movable than in the switch movable contact body in which the upwardly curved upper surface of the movable contact is bonded to the sheet in its entirety.

According to a fourth aspect of the invention, in the panel switch movable contact body according to the first aspect of the invention, the adhesive agent is coated on the lower surface of the sheet in such a manner that the adhesive agent is not applied to the part of the lower surface of the sheet which corresponds to the lower peripheral edge of the movable contact. In the panel switch movable contact body, the entrance of the adhesive agent of the sheet into the movable contact is more positively prevented.

According to a fifth aspect of the invention, in the panel switch movable contact body according to the first aspect of the invention, the dome-shaped movable contact has a small hole at the central top, and the adhesive agent is coated on the lower surface of the sheet in such a manner that the adhesive agent is not applied to the part of the sheet which is located around the small hole. Hence, in the movable contact body, the entrance of the adhesive agent into the movable contact through the small hole is prevented.

According to a sixth aspect of the invention, in the panel switch movable contact body according to the first aspect of the invention, a depressing protrusion is formed on the part of the upper surface of the sheet which corresponds to the central top of the movable contact. The movable contact body is advantageous in that, even if, in assembling the push button and the panel switch together, the center of the movable contact is shifted from the center of the push button, owing to the depressing protrusion a depressing force acts on the central portion of the movable contact at all times, and therefore the movable contact positively performs reverse motion.

According to a seventh aspect of the invention, in the panel switch thus structured, the panel switch movable contact body according to the first aspect of the invention is bonded through the adhesive agent of the sheet to a wiring board having a central stationary contact and an outside stationary contact, in such a manner that the outer peripheral edge of the dome-shaped movable contact is on the outside stationary contact while the central top thereof is confronted with the central stationary contact. Hence, the panel switch is low in manufacturing cost, and the work of bonding the movable contact body to the wiring board is achieved with ease.

The above and other objects and features of the present invention will be more apparent from the following description taken in conjunction with the accompanying drawings.

DETAILED DESCRIPTION OF THE PREFERRED EMBODIMENTS

Figure 1A:
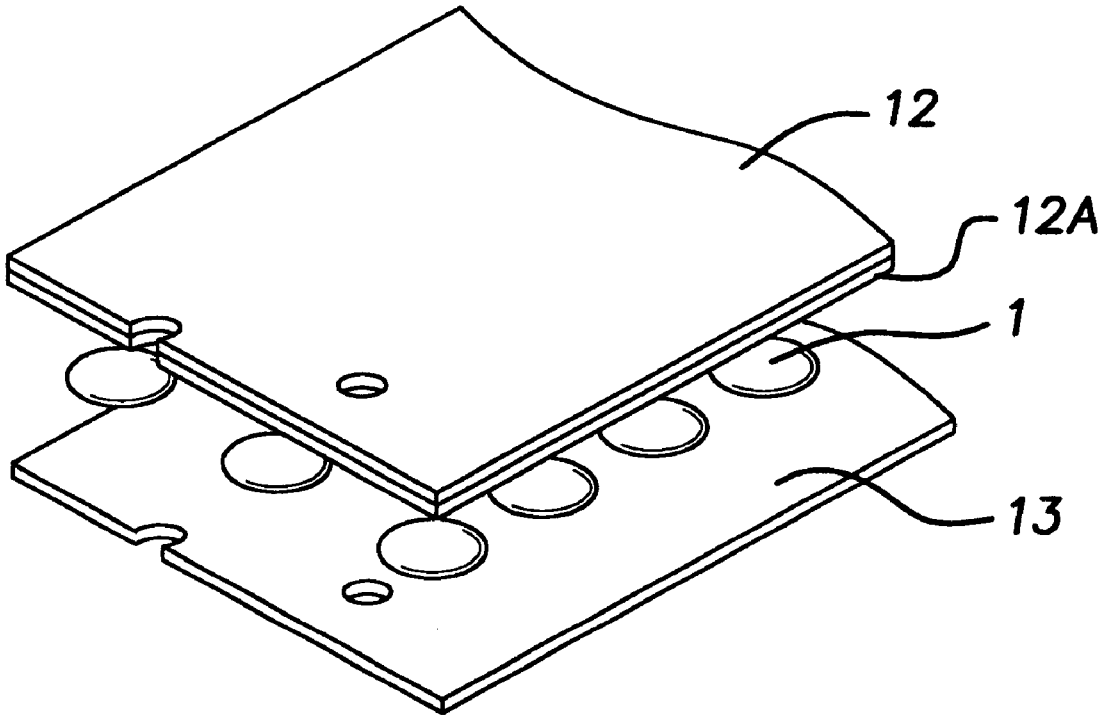
FIGS. 1A and 1B are an exploded perspective view and a sectional view, respectively, showing an example of a panel switch movable contact body, which constitutes a first embodiment of the invention.

Preferred embodiments of the invention will be described with reference to FIGS. 1A, 1B to 7A, 7B, in which parts corresponding functionally to those already described with reference to the prior art (FIGS. 8A, 8B and 9A, 9B) are therefore designated by the same reference numerals or characters.

(First Embodiment)

Figure 1B:
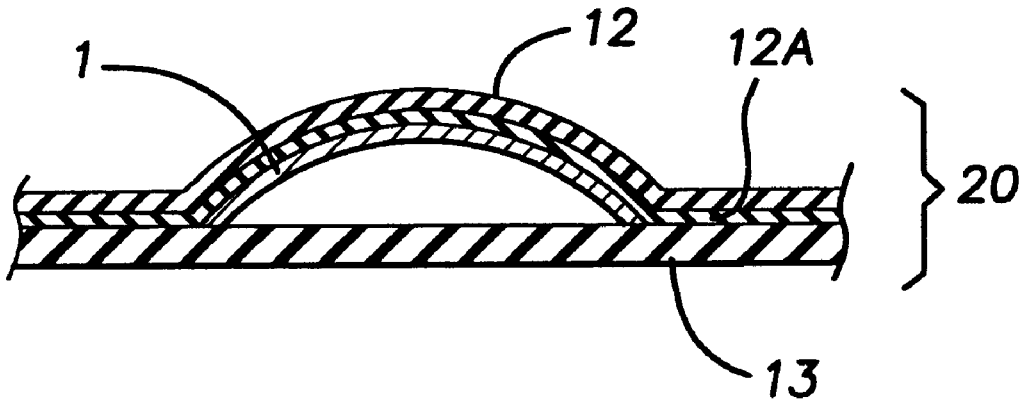

FIGS. 1A and 1B are an exploded perspective view and a sectional view, respectively, showing an example of a panel switch movable contact body, which constitutes a first embodiment of the invention. In those figures, reference numeral 1 designates a dome-shaped movable contact made of a thin, elastic, metal plate; and 12, a sheet made of an insulating film. An adhesive agent 12A is applied to the lower surface of the sheet 12. The movable contact 1 is secured to the sheet through the adhesive agent 12 in such a manner that the upwardly curved upper surface thereof is covered with the sheet 12. Further in the figures, reference numeral 13 designates a separator which is made of paper or insulating film to protect the movable contacts 1 and prevent the corrosion of the movable contacts 1 by the gases in air or the sticking of foreign matters thereto. The separator 13 is bonded to the lower surface of the sheet 12 through the adhesive agent 12A, to close the opening of the dome-shaped movable contact. Thus, a panel switch movable contact body 20 has been manufactured.

Figure 2A:
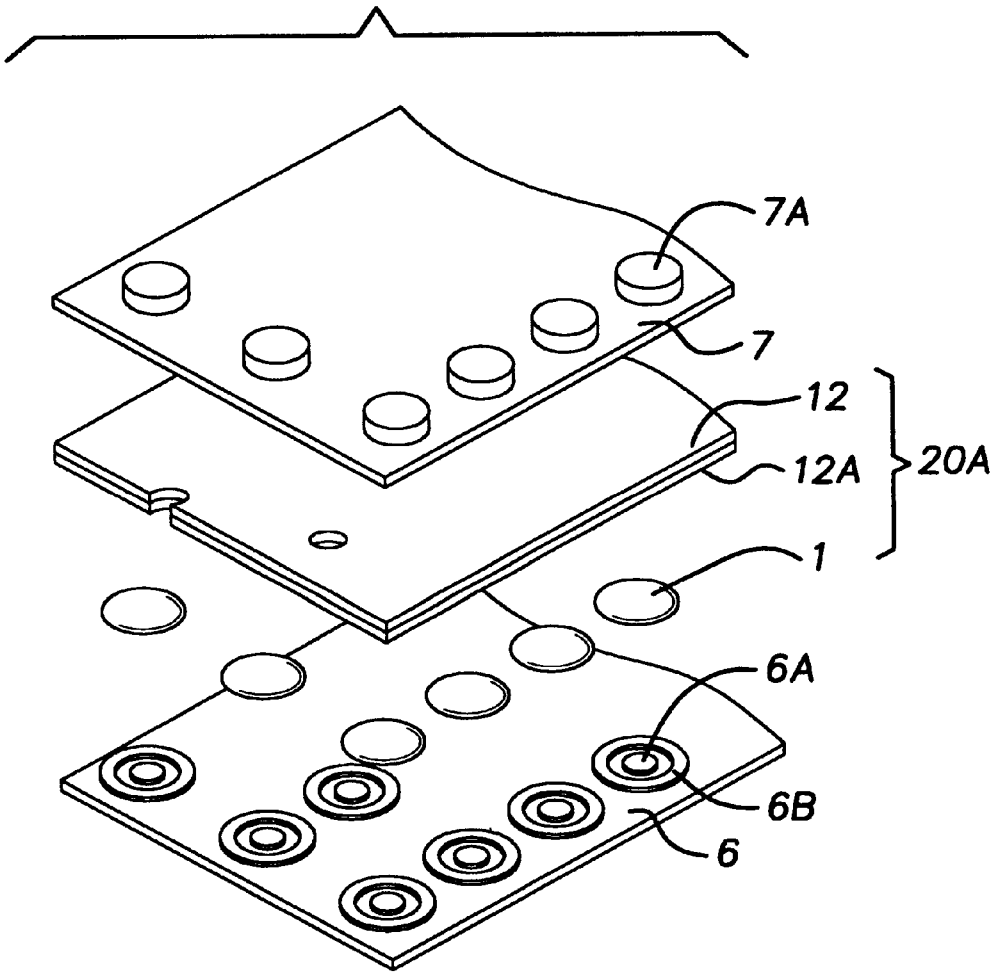
FIGS. 2A and 2B are an exploded perspective view and a sectional, respectively, showing a panel switch employing the above-described movable contact body.
Figure 2B:
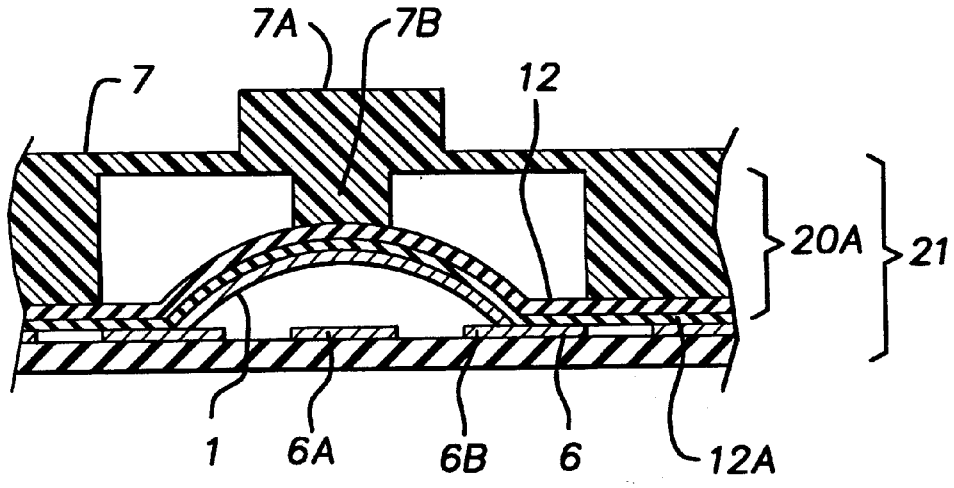

FIGS. 2A and 2B are an exploded perspective view, and a sectional view of a panel switches using the above-described panel switch movable contact bodies. In those figures, reference numeral 6 designates a wiring board (or printed circuit board) which has central stationary contacts 6A and outside stationary contacts 6B. The separator 13 is removed from the panel switch movable contact bodies 20, to form panel switch movable contact bodies 20A. The latter 20A are bonded to the wiring board 6 through the adhesive agent 12A (provided on the lower surface of the sheet 12 in such a manner that the outer periphery of each of the movable contacts 1 is on the respective outer stationary contact, while the top of the dome-shaped movable contact 1 is confronted with the respective central stationary contact. Thus, panel switches have been manufactured.

Similarly as in the case of the prior art, a push button 7 of flexible rubber or resin is set above each of the panel switch thus manufactured. When the operating section 7A of the push button 7 is depressed, a depressing portion 7B formed on the lower surface of the operating section 7A is caused to depress the movable contact 1 through the sheet 4. As a result, the movable contact 1 performs reverse motion, so that the central part thereof is brought into contact with the central stationary contact 6A; that is, the central stationary contact 6A of the wiring board 6 is electrically connected to the outside stationary contact 6B. Upon release of the push button 7, the elastic restoring force of the movable contact 1 acts to disconnect the central part of the movable contact 1 from the central stationary contact 6A; that is, the panel switch is turned off as shown in FIG. 2B.

As is apparent from the above description, in the first embodiment of the invention, each panel switch movable contact body is made up of three components, namely, the movable contact 1, the sheet 12, and the separator 13. Hence, it is small in the number of components, and small in the number of bonding steps, and can be assembled with ease. Thus, the panel switch movable contact body is low in manufacturing cost. Accordingly, the panel switch 21 formed by using the movable contact body is also low in manufacturing cost. The panel switch movable contact body can be bonded to the wiring board with ease.

(Second Embodiment)

Another example of the panel switch movable contact body, which constitutes a second embodiment of the invention, will be described with reference to FIGS. 3A and 3B.

Figure 3A:
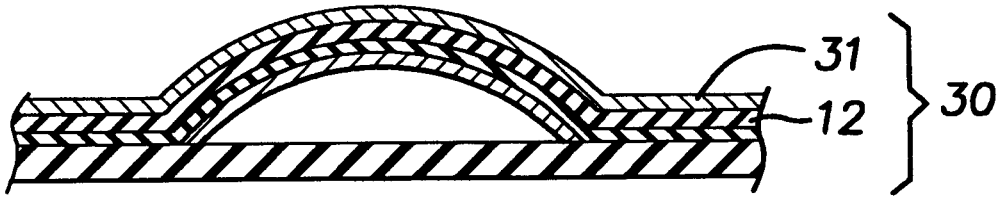
FIG. 3A is a sectional view showing another example of the panel switch movable contact body, which constitutes a second embodiment of the invention.
Figure 3B:
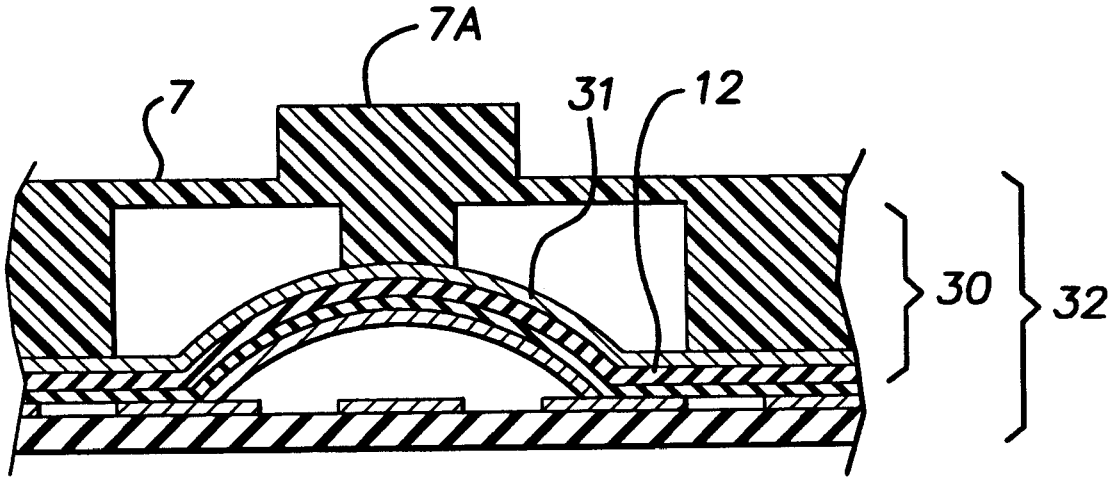
FIG. 3B is a sectional view showing a panel switch employing the movable contact body.

FIG. 3A is a sectional view of the panel switch movable contact body, the second embodiment, and FIG. 3B is a sectional view of a panel switch using the movable contact body. The panel switch movable contact body 30 is obtained as follows: That is, a conductive film 31 is printed on the upper surface of the sheet 12 of the panel switch movable contact body 20 of the first embodiment by using a silver-based or carbon-based paste.

A panel switch 32 is formed by using the above-described panel switch movable contact body 30 (cf. FIG. 3B). For instance when the operating section 7A of a push button 7 is depressed, static electricity may be produced; however, the static electricity thus produced is completely grounded through the conductive film 31 formed on the whole upper surface of the sheet 12 of the movable contact body 30. Hence, on the side of the electronic equipment which has the panel switch 32 of the invention, it is unnecessary to devise a countermeasure against static electricity at the part of the electronic equipment where the panel switch is installed. This feature eliminates the provision of electronic components which are heretofore required for devising a countermeasure against static electricity, and accordingly greatly diminishes the number of manufacturing steps. Hence, although the panel switch 32 with the conductive film is somewhat higher in manufacturing cost, the amount of increase in manufacturing cost can be sufficiently absorbed. With all the factors considered, it can be said that small electronic equipment in which a countermeasure against static electricity is completely devised can be provided at low manufacturing cost.

(Third Embodiment)

Another example of the panel switch movable contact body, which constitutes a third embodiment of the invention, will be described with reference to FIGS. 4A, 4B and 5A, 5B.

Figure 4A:
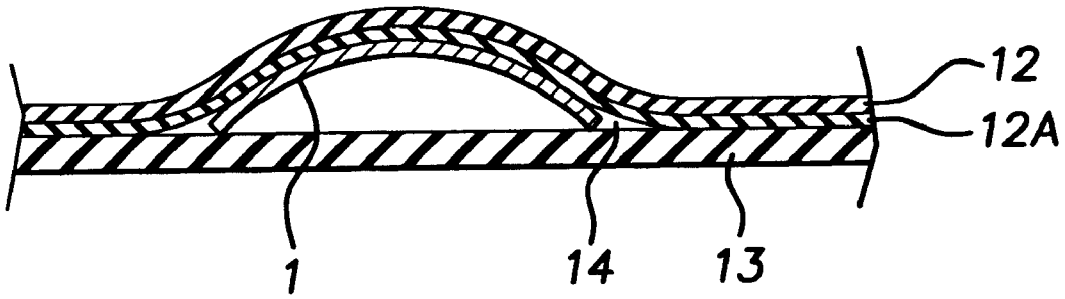
FIG. 4A is a sectional view showing another example of the panel switch movable contact body, which constitutes a third embodiment of the invention.
Figure 4B:
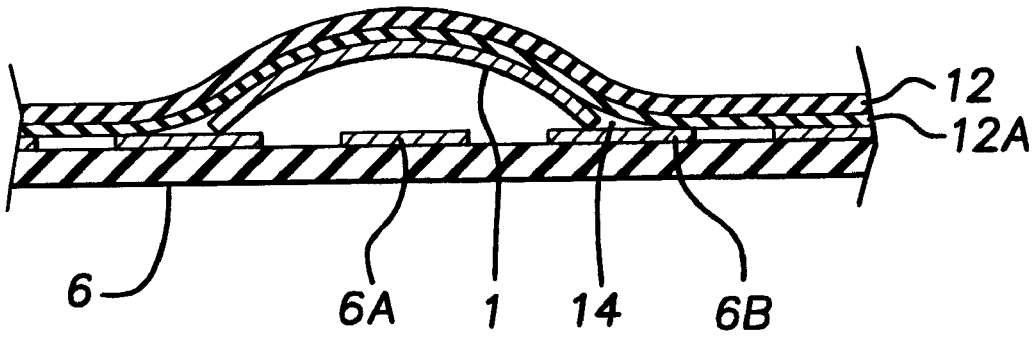
FIG. 4B is a sectional view showing a panel switch employing the movable contact body.

FIG. 4A is a sectional view of the panel switch movable contact body, the third embodiment of the invention; and FIG. 4B is also a sectional view of a panel switch using the movable contact body shown in FIG. 4A. As shown in those figures, a movable contact 1 is upwardly curved (dome-shaped) and covered with a sheet 12, and bonded to the latter 12 in such a manner that the peripheral edge of the movable contact 1 is slightly spaced from the adhesive agent 12A of the sheet 12 to form a gap 14.

As was described above, the gap 14 is formed between the peripheral edge of the dome-shaped movable contact 1 and the bonding surface of the sheet 12. This feature prevents the entrance of the adhesive agent 12*a* of the sheet 12 into the movable contact 1 along the peripheral edge of the latter 1, and eliminates the difficulty that the movable contact is interrupted from being brought into contact with the central stationary contact 6A and the outside stationary contact 6B. Furthermore, in the third embodiment, when compared with the case where the upwardly curved upper surface of the movable contact 1 is covered with the sheet 12 in its entirety, the reverse motion of the movable contact 1 is not obstructed by the sheet 12. That is, the panel switch is smoothly operated.

Figure 5A:
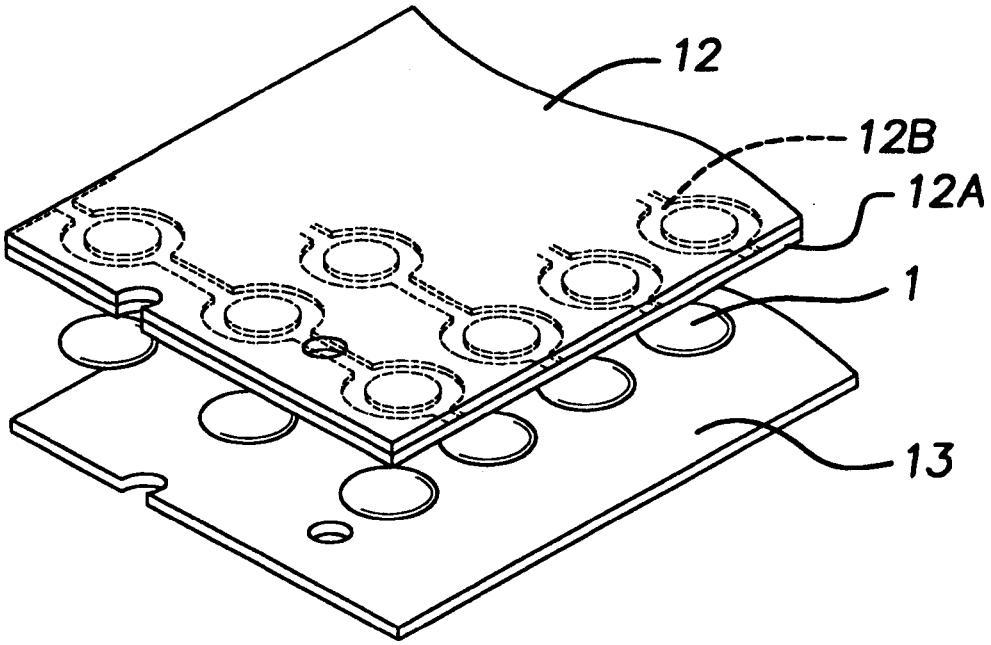
FIG. 5A is an exploded perspective view showing another example of the panel switch movable contact body having a sheet exposed section.
Figure 5B:
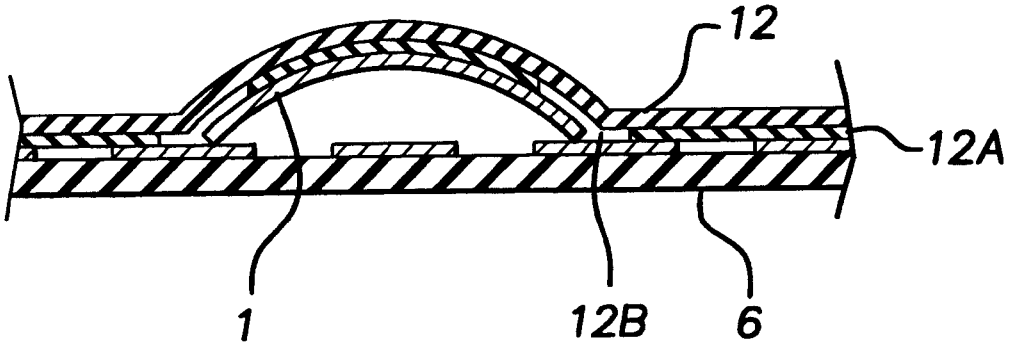
FIG. 5B is a sectional view of a panel switch employing the movable contact body.

FIGS. 5A and 5B show one modification of the above-described third embodiment. More specifically, FIG. 5A is an exploded perspective view of one modification of the above-described panel switch movable contact body, and FIG. 5B is a sectional view of a panel switch using the movable contact body shown in FIG. 5A.

As shown in those figures, the sheet 12 has a sheet-exposed section 12B (where no adhesive agent 12A is applied) around the lower peripheral edge of the dome-shaped movable contact 1. This feature positively prevents the entrance of the adhesive agent 12*a* into the movable contact 1 along the peripheral edge of the latter 1.

(Fourth Embodiment)

Figure 6A:
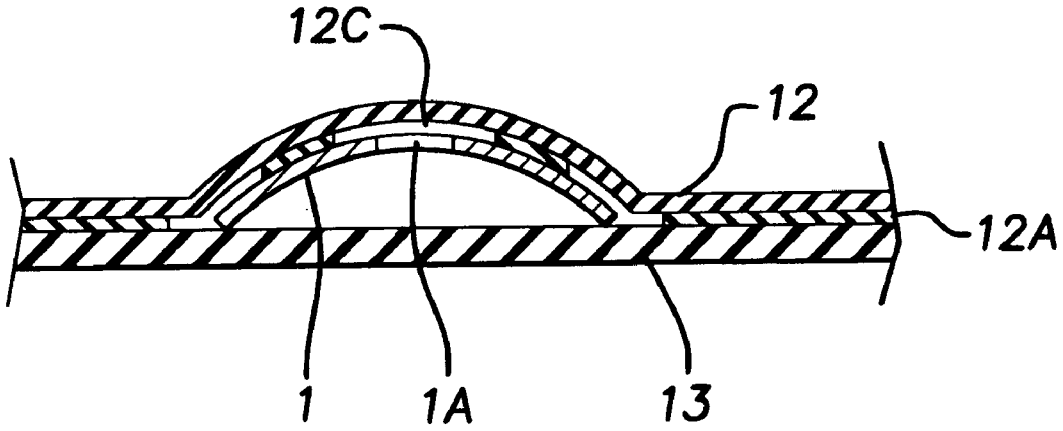
FIG. 6A is a sectional view showing another example of the panel switch movable contact body, which constitutes a fourth embodiment of the invention.
Figure 6B:
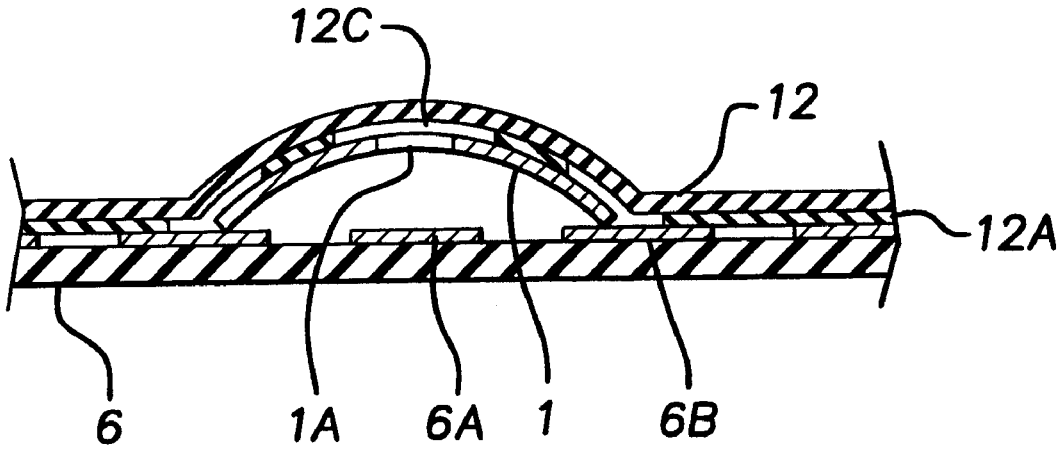
FIG. 6B is a sectional view of a panel switch employing the movable contact body.

FIG. 6A is a sectional view showing another example of the panel switch movable contact body, which constitutes a fourth embodiment of the invention; and FIG. 6B is a sectional view showing a panel switch using the movable contact body shown in FIG. 6A.

As shown in those figures, the top of a dome-shaped movable contact 1 has a small hole 1A. The part of the lower surface of the sheet 12 which is around the small hole 1A is a sheet exposed section 12C where no adhesive agent 12 is applied.

A panel switch formed using the movable contact body functions as follows: Similarly as in the case of the prior art, when the operating section of a push button (not shown) arranged above the panel switch is depressed, the movable contact 1 is depressed through the sheet 12 a depression portion formed on the lower surface of the operating section, so that the movable contact performs reverse motion, so that the central portion is brought into contact with the central stationary contact 6A. However, in the fourth embodiment, the peripheral edge of the small hole la formed in the top of the movable contact 1 is brought into contact with the central stationary contact 6A. Hence, the movable contact is more positively brought into contact with the central stationary contact 6A.

The part of the lower surface of the sheet 12 which is around the small hole 1A of the movable contact 1, is not coated with the adhesive agent 12A; that is, the part is employed as a sheet exposed section 12C. Hence, the entrance of the adhesive agent 12A into the movable contact 1 through the small hole 1A is prevented.

(Fifth Embodiment)

Figure 7A:
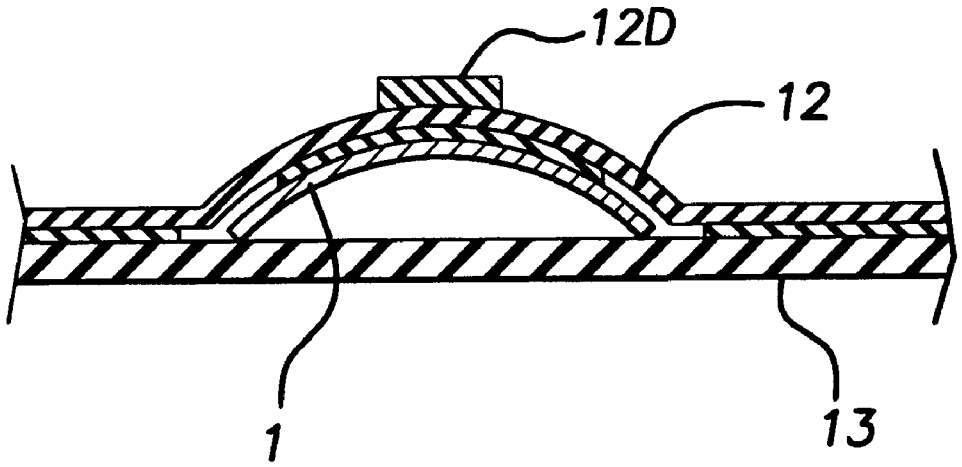
FIG. 7A is a sectional view showing another example of the panel switch movable contact body, which constitutes a fifth embodiment of the invention.
Figure 7B:
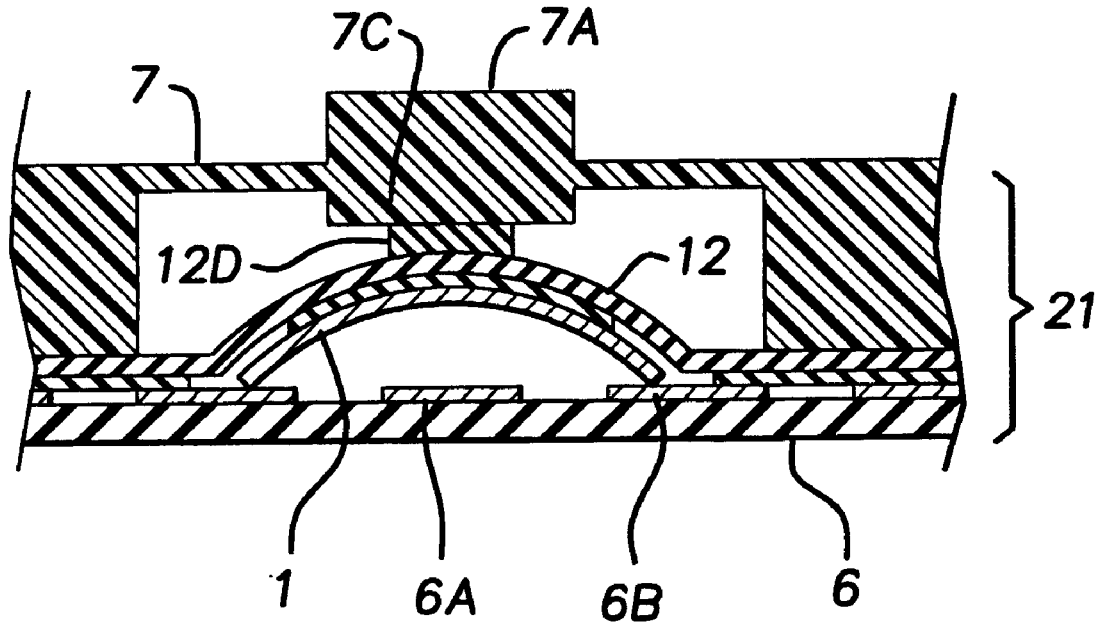
FIG. 7B is a sectional view of a panel switch employing the movable contact body.
Figure 8A:
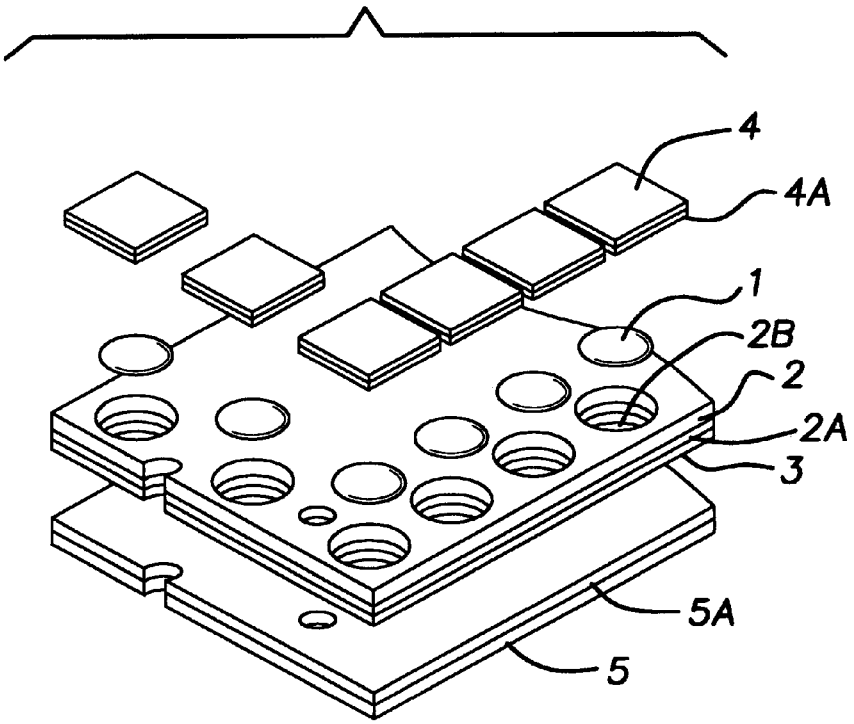
FIG. 8A PRIOR ART
FIGS. 8A and 8B are an exploded perspective view, and a sectional view, respectively, showing a conventional panel switch movable contact body.
Figure 8B:
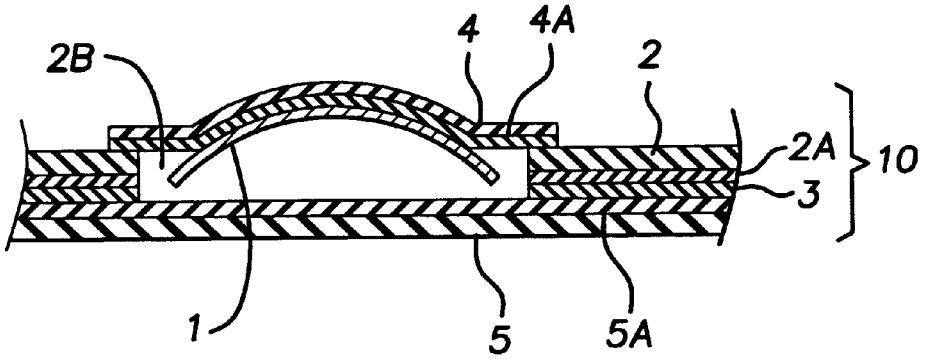
FIG. 8B PRIOR ART
Figure 9A:
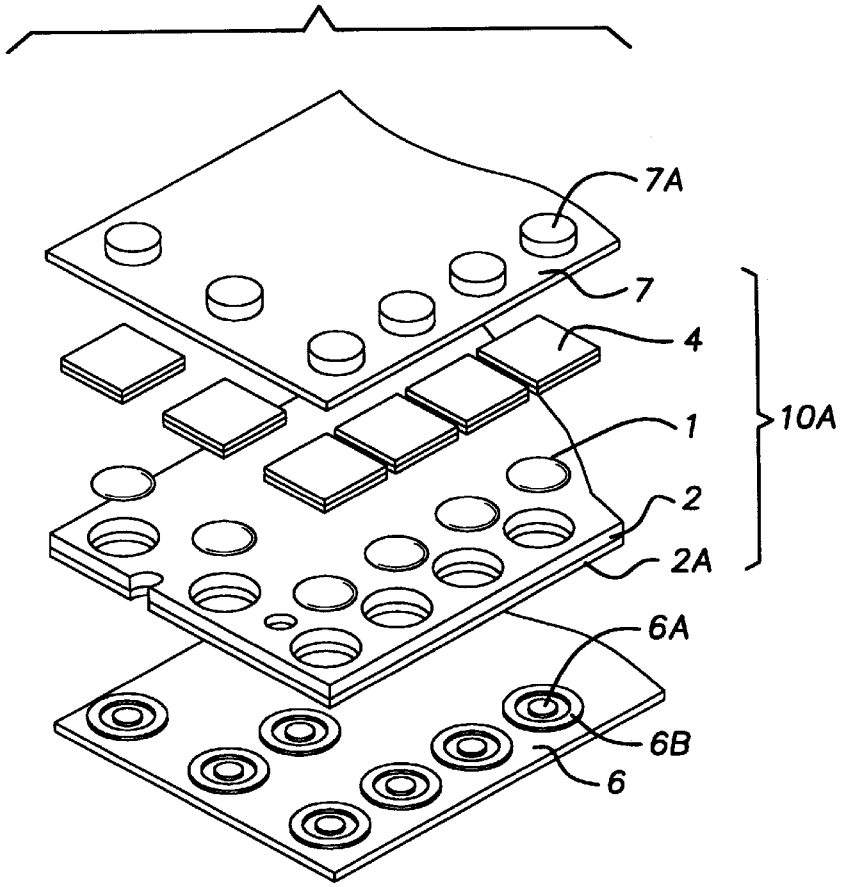
FIG. 9A PRIOR ART
FIGS. 9A and 9B are an exploded perspective view, and a sectional view, respectively, showing a conventional panel switch.
Figure 9B:
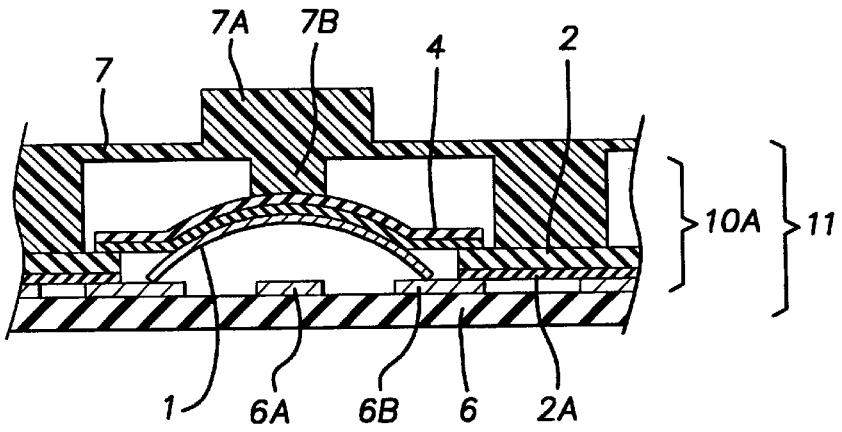
FIG. 9B PRIOR ART

FIG. 7A is a sectional view of another example of the panel switch movable contact body, which constitutes a fifth embodiment of the invention; and FIG. 7B is a sectional view of a panel switch using the movable contact body shown in FIG. 7A.

As shown in those figures, a depressing protrusion 12D is provided on the part of the upper surface of the sheet 12 which corresponds to the top of the dome-shaped movable contact 1. A depressing portion 7C having a wide depressing surface is formed on the lower surface of the push button 7.

When the operating section 7A of the push button 7 which is provided above the panel switch, the depressing portion 7C formed on the lower surface of the operating section 7A depresses the depressing protrusion 12D of the sheet 12. As a result, the movable contact 1 performs reverse motion, so that the central portion thereof is brought into contact with the central stationary contact 6A, whereby the latter 6A is electrically connected to the outside stationary contact 6B.

As is apparent from the above description, in the panel switch, the depressing portion 7C of the push button 7 depresses the movable contact 1 through the depressing protrusion 12 formed on the upper surface of the sheet 12. Hence, even if, in assembling the push button 7 and the panel switch 21 together, the center of the movable contact 1 is shifted from the center of the depressing portion 7C, owing to the depressing protrusion 12D a depressing force acts on the central portion of the movable contact 1 at all times. Hence, the movable contact positively performs reverse motion.

As is apparent from the above description, according to the invention, it is possible to provide a panel switch movable contact body which is small in the number of components, simple in assembling work, and low in manufacturing cost, and in which a countermeasure is devised against static electricity which may sneak in the concerning electronic equipment, and to provide a panel switch using the movable contact body.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A movable contact body for a panel switch, said movable contact body comprising:

a sheet made of an insulating film, said sheet having an upper surface and a lower surface, said lower surface being coated with an adhesive agent;

a conductive film formed on the upper surface of said sheet;

a dome-shaped movable contact, said movable contact being formed from a thin elastic metal plate and being directly bonded to the adhesive agent on the lower surface of said sheet such that an upwardly curved upper surface of said movable contact is covered by said sheet; and a separator releasably bonded to the adhesive agent on said lower surface of said sheet and covering a lower opening of said dome-shaped movable contact.

2. A panel switch comprising a movable contact body as claimed in claim 1, wherein, after said separator is released from said adhesive agent, said adhesive agent is bonded to a wiring board, said wiring board having a central stationary contact and an outside stationary contact, and wherein an outer peripheral edge of said dome-shaped movable contact is in contact with said outside stationary contact while a central top portion of said movable contact confronts the central stationary contact.

3. A movable contact body for a panel switch, said movable contact body comprising:

a sheet made of an insulating film, said sheet having an upper surface and a lower surface, said lower surface being coated with an adhesive agent;

a dome-shaped movable contact formed from a thin elastic metal plate, said movable contact being directly bonded to the adhesive agent on the lower surface of said sheet such that an upwardly curved upper surface of said movable contact is covered by said sheet and such that a lower peripheral edge of said movable contact is spaced from the adhesive agent on the lower surface of said sheet; and a separator releasably bonded to the adhesive agent on said lower surface of said sheet and covering a lower opening of said dome-shaped movable contact.

4. A panel switch comprising a movable contact body as claimed in claim 3, wherein, after said separator is released from said adhesive agent, said adhesive agent is bonded to a wiring board, said wiring board having a central stationary contact and an outside stationary contact, and wherein an outer peripheral edge of said dome-shaped movable contact is in contact with said outside stationary contact while a central top portion of said movable contact confronts the central stationary contact.

5. A movable contact body for a panel switch, said movable contact body comprising:

a sheet made of an insulating film, said sheet having an upper surface and a lower surface, said lower surface being coated with an adhesive agent;

a dome-shaped movable contact, said movable contact being formed from a thin elastic metal plate and being directly bonded to the adhesive agent on the lower surface of said sheet such that an upwardly curved upper surface of said movable contact is covered by said sheet; and a separator releasably bonded to the adhesive agent on said lower surface of said sheet and covering a lower opening of said dome-shaped movable contact;

wherein said adhesive agent is coated on the lower surface of said sheet such that said adhesive agent is not applied to a part of said lower surface of said sheet which corresponds to the lower peripheral edge of said movable contact.

6. A panel switch comprising a movable contact body as claimed in claim 5, wherein, after said separator is released from said adhesive agent, said adhesive agent is bonded to a wiring board, said wiring board having a central stationary contact and an outside stationary contact, and wherein an outer peripheral edge of said dome-shaped movable contact is in contact with said outside stationary contact while a central top portion of said movable contact confronts the central stationary contact.

7. A movable contact body for a panel switch, said movable contact body comprising:

a sheet made of an insulating film, said sheet having an upper surface and a lower surface, said lower surface being coated with an adhesive agent;

a dome-shaped movable contact defining a hole at a central, top portion thereof, said movable contact being formed from a thin elastic metal plate and being directly bonded to the adhesive agent on the lower surface of said sheet such that an upwardly curved upper surface of said movable contact is covered by said sheet; and a separator releasably bonded to the adhesive agent on said lower surface of said sheet and covering a lower opening of said dome-shaped movable contact;

wherein said adhesive agent is coated on the lower surface of said sheet such that said adhesive agent is not applied to a part of said sheet which is located around said hole.

8. A panel switch comprising a movable contact body as claimed in claim 7, wherein, after said separator is released from said adhesive agent, said adhesive agent is bonded to a wiring board, said wiring board having a central stationary contact and an outside stationary contact, and wherein an outer peripheral edge of said dome-shaped movable contact is in contact with said outside stationary contact while a central top portion of said movable contact confronts the central stationary contact.

9. A movable contact body for a panel switch, said movable contact body comprising:

a sheet made of an insulating film, said sheet having an upper surface and a lower surface, said lower surface being coated with an adhesive agent;

a dome-shaped movable contact, said movable contact being formed from a thin elastic metal plate and being directly bonded to the adhesive agent on the lower surface of said sheet such that an upwardly curved upper surface of said movable contact is covered by said sheet; and a separator releasably bonded to the adhesive agent on said lower surface of said sheet and covering a lower opening of said dome-shaped movable contact;

wherein a depressing protrusion is formed on a part of the upper surface of said sheet which corresponds to a central top of said movable contact.

10. A panel switch comprising a movable contact body as claimed in claim 9, wherein, after said separator is released from said adhesive agent, said adhesive agent is bonded to a wiring board, said wiring board having a central stationary contact and an outside stationary contact, and wherein an outer peripheral edge of said dome-shaped movable contact is in contact with said outside stationary contact while a central top portion of said movable contact confronts the central stationary contact.

* * * * *